US005121576A

United States Patent [19]

Wu

[11] Patent Number: 5,121,576

[45] Date of Patent: Jun. 16, 1992

[54] PLASTIC FLOOR TILE

[76] Inventor: Yu J. Wu, P.O. Box 1-79, Taipei, Taiwan

[21] Appl. No.: 520,559

[22] Filed: May 8, 1990

[51] Int. Cl.[5] ..... E04C 2/20

[52] U.S. Cl. ..... 52/309.1; 52/309.13; 52/590; 52/612

[58] Field of Search ..... 52/572, 573, 387, 595, 52/605, 221, 98, 99, 506, 508, 144, 145, 612, 584–592, 605, 309.1, 309.13

[56] References Cited

U.S. PATENT DOCUMENTS 1,808,591 6/1931 Bruce ..... 52/573 X 2,269,927 1/1942 Crooks ..... 52/573 X 2,950,575 8/1960 Hellwig ..... 52/221

*Primary Examiner*—James L. Ridgill, Jr.

*Attorney, Agent, or Firm*—Lalos & Keegan

[57] ABSTRACT

An improved plastic floor tile formed with an internal stress eliminating structure including grooves or recesses disposed on the lower surface of the floor tile at four corners and four sides thereof, whereby contractile internal stress caused by thermal change can be interrupted from reaching the four corners or margin portions of the floor tile by the internal stress eliminating structure so as to effectively prevent distortion of the four corners or margin portions.

1 Claim, 1 Drawing Sheet

PLASTIC FLOOR TILE

BACKGROUND OF THE INVENTION

The present invention relates to an improved plastic floor tile, and more particularly to a plastic floor tile, the lower face of which is formed with an internal stress-eliminating structure at four corners or margin portions so as to interrupt internal stress from reaching the corners or margin portions and prevent distortion thereof due to thermal change.

Conventional PVC floor tile, PVC color floor tile, PVC hollow floor tile, PVC asbestos floor tile and PVC soft pressed floor tile are more and more widely used due to their easy working, fine printed stripes, low price and slip-proof characters.

However between, these plastic floor tiles go through procedures of mixing, heating, pressing, lamination and pressing molding to form a laminated floor tile structure, and because PVC. filling, stabilizer, plasticizer, etc., are added to raw material with greatly different proportions for example, the proportion of filling is relatively large, and the affinity between these components are not in unison, therefore, when mixed, these components can be hardly uniformly mixed, and thus the floor tiles always are not uniformly composed of these components so that internal stress is created. Moreover, due to contractile character of PVC, the four corners and side edges of the plastic floor tile often suffer the internal stress caused by thermal change so that the four corners are often distorted or upward bent. As a result, after laid on the floor, the plastic floor tile is apt to contract and deform.

It is therefore tried by the inventor to research this problem and eliminate the aforesaid shortcomings. As shown in FIG. 1, because the components of the plastic floor tile are different from one another in molecular structure, therefore when under thermal change, the arrangement of the molecules of plastic floor tile is apt to vary to create inward internal stresses as indicated by arrows A, B, C, D, E, F, G, H in FIG. 1. Therefore, the floor tile is easy to inward contract Since the adhereing force of four corners to the floor appears to be relatively small in comparison with that of other portions of the floor tile, while the internal stress applied to four corners is larger than that of the other portions, therefore the distortion or bending of four corners of plastic floor tile is inevitable.

SUMMARY OF THE INVENTION

It is the primary object of this invention to provide an improved plastic floor tile wherein an internal stress-eliminating structure is provided on the lower face of the floor tile to interrupt internal stress from extending to four corners and four sides and effectively eliminate deformation or bending of the floor tile to assure stable quality thereof.

It is a further object of this invention to provide the above improved plastic floor tile, which can be permanently closely smoothly laid on the floor without deformation.

The present invention can be best understood through the following description with reference to accompanying drawings wherein:

DETAILED DESCRITPION OF THE PREFERRED EMBODIMENTS

To easily describe the present invention, a square PVC floor tile with four laminas is exemplified.

To eliminate the shortcomings of conventional floor tile, an internal stress-eliminating structure 10 is formed on the floor tile whereby when internal stress is created to distort four corners or sides, the structure 10 can interrupt the internal stress, permitting the floor tile to smoothly adhere to the floor without deformation, and keeping the sides of the floor tile straightly laid on the floor.

Figure 1:
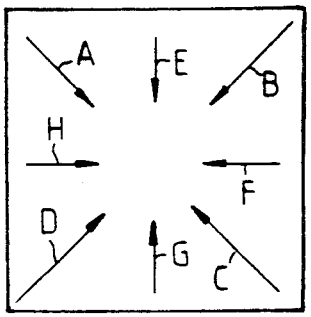
FIG. 1 illustrates the deformation of plastic floor tile.
Figure 2:
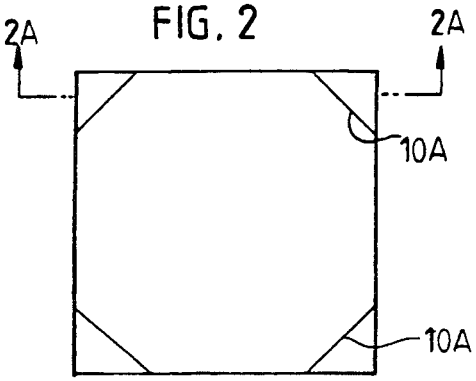
FIG. 2 shows first embodiment of internal stress-eliminating structure of this invention.

Please refer to FIG. 2, which shows a first embodiment of this invention. At four corners, four slant grooves 10A are formed on the lower face of a plastic floor tile for interrupting internal stress. The depth of the grooves 10A can be modified according to actual requirement. If the thickness of the floor tile is greater or the PVC percentage thereof is higher, then the depth of the grooves 10A can be increased to thoroughly interrupt internal stresses indicated by arrows A, B, C, D directed to central portion of the floor tile. While the width of the grooves 10A can be also modified as necessary and the length of the grooves, i.e., the length of bottom sides of the triangles formed at the corners, is determined by components and thickness of the floor tile.

As shown in FIG. 2, the slant grooves 10A can interrupt the internal stress directed from the corners to the central portion of the floor tile so that the internal stress can not reach the corner, enabling the four corners to be closely attached to the floor. Accordingly, the grooves 10A with appropriate depth allow the floor tile to be easily smoothly laid on the floor by adhesive force without deformation. Corner distortion due to weather or environment affection can be effectively deleted.

Figure 3:
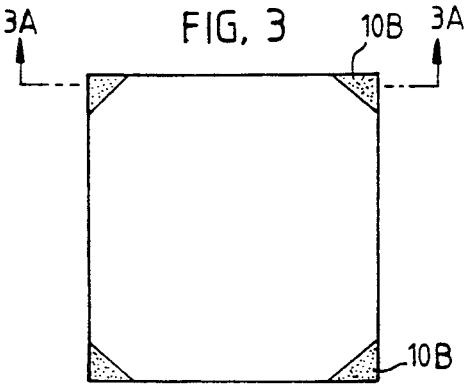
FIG. 3 shows second embodiment of this invention.
Figure 3A:
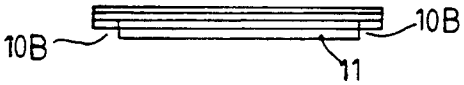
FIG. 3A is a sectional view taken on the line 3A—3A of FIG. 3.
Figure 2A:
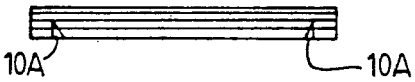
FIG. 2A is a sectional view taken on th eline 2A—2A of FIG. 2.

Referring to FIG. 3, which shows a second embodiment of the internal stress-eliminating structure 10, wherein four cut portions 10B are formed at four corners. As shown in FIG. 3A, at four corners, a part of a base lamina 11 of the floor tile is cut away to form the cut portions 10B. Similarly, the size and depth of these cut portions 10B are determined by the size and components and use of the floor tile.

Figure 4:
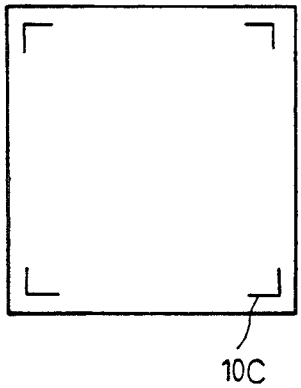
FIGS. 4 and 4A show third embodiment of this invention.
Figure 4A:
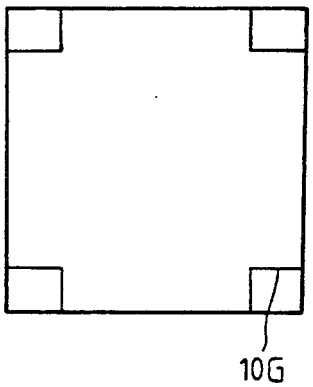

Further referring to FIGS. 4 and 4A, which show a embodiment of this invention, wherein the internal stress eliminating effect is achieved by four outward pointed right angle grooves 10C or flour inward pointed right angle grooves 10G. Also, the length, depth and distance of the grooves from the margins of the floor tile are determined by the size and use of the floor tile.

Figure 5:
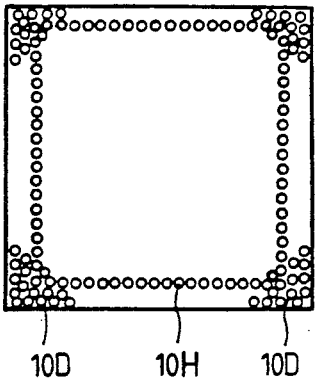
FIG. 5 shows fourth embodiment of this invention.

Referring to FIG. 5, which shows a fourth embodiment of this invention, in which multiple recesses 10D are formed at four corners on the lower face of the floor tile by a press machine. These recesses 10D can be scattered in a triangle pattern or other patterns, and between groups of recesses 10D, a line of recesses 10H can be formed to connect these groups. It is important that the scattering pattern of the recesses 10D must interrupt the internal stress extended to four corners so as to eliminate the drawback of distortion of the corners.

Figure 6:
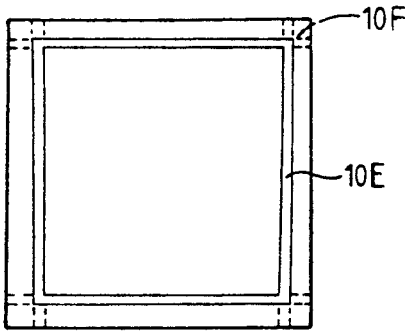
FIG. 6 shows fifth embodiment of this invention.

Referring to FIG. 6, which shows a fifth embodiment of this invention, wherein a peripheral square groove 10E or a #-shaped groove 10F shown by dotted lines is formed on margin portion of the floor tile so as to thoroughly interrupt the path of internal stress toward four corners and sides and prevent distortion thereof caused by weather and environment affection.

It should be noted that the square PVC floor tile with four laminas is only examplified to describe this invention. Actually, this invention can be applied to other non-square plastic floor tile with single or multiple laminas to achieve the same effect.

I claim:

1. An improved plastic floor tile having multiple laminas composed of PVC, filling, stabilizer, plasticizer, said floor tile having a lower surface, sides and four corners, said floor tile being subject to an internal stress extending from a center of said tile a structure being formed on said lower surface of the floor tile for interrupting and preventing said internal stress extending from the center of the tile from reaching the four corners and to prevent distortion of said tile thereof, and wherein said stress-interrupting structure includes four slant grooves disposed across said four corners, forming four triangles together with said sides of the floor tile.

* * * * *